United States Patent [19]

Mazanek

[11] 4,031,311

[45] June 21, 1977

[54] ELECTRICAL BUSHING

[75] Inventor: Alfonso J. Mazanek, Hermitage, Pa.

[73] Assignee: Westinghouse Electric Corporation, Pittsburgh, Pa.

[22] Filed: Mar. 15, 1976

[21] Appl. No.: 666,809

[52] U.S. Cl. ..... 174/31 R; 174/152 R
[51] Int. Cl.[2] ..... H01B 17/26; H01B 17/34
[58] Field of Search ..... 174/12 BH, 14 BH, 15 BH, 174/16 BH, 18, 31 R, 31.5, 110 N, 137 B, 142, 143, 152 R, 153 R, 167

[56] References Cited

FOREIGN PATENTS OR APPLICATIONS

| | | | |
|---|---|---|---|
| 512,217 | 4/1955 | Canada | 174/12 BH |
| 583,281 | 9/1959 | Canada | 174/31 R |
| 873,751 | 7/1961 | United Kingdom | 174/152 R |

OTHER PUBLICATIONS

DuPont brochure entitled "Nomex Nylon", 12 pages, received PTO July 17, 1969.
DuPont Nomex Nylon Bulletin N–195, Sept. 1965, 3 pages.
(SO198–0026) Ricketts, C. E., "Ceramic Insulators", paper presented at BEAMA Electrical Insulation Conference, London, England, Apr. 8–10, 1970, only pp. 1 and 2 relied on.
*Electrical World*, vol. 160, No. 7, Aug. 12, 1963, p. 75.

*Primary Examiner*—Laramie E. Askin
*Attorney, Agent, or Firm*—D. R. Lackey

[57] ABSTRACT

An electrical bushing assembly suitable for operation in an ambient temperature of 150° C. The electrical bushing assembly includes a ferrous electrical conductor insulated with wholly aromatic polyamide fibers impregnated with silicone oil and surrounded by a ceramic insulating member which includes $Al_2O_3$.

1 Claim, 2 Drawing Figures

ELECTRICAL BUSHING

BACKGROUND OF THE INVENTION

1. Field of the Invention

The invention relates in general to electrical insulating bushings, and more specifically to electrical insulating bushings capable of operating satisfactorily at elevated temperatures.

2. Description of the Prior Art

Conventional insulating bushings for electrical apparatus, such as transformers, circuit breakers, and the like, normally have an ambient temperature limitation of about 100° C. Hot precipitators used to remove solid particles in hot exhaust gases operate in an ambient above 150° C, and it would be desirable to mount the power supply for such precipitators on the precipitator itself in order to reduce the distance between the high voltage bushing of the power supply and the plates of the precipitator.

Attempts to use a conventional electrical bushing in the precipitator power supply have resulted in early bushing failure due to one or more causes, such as thermal run away of the porcelain insulating member, dielectric failure of the insulating papers and mineral oil, and thermally induced leaks in the bushing assembly which enable the insulating fluid to escape from the bushing cavity. Baffling may be installed in the duct work between the power supply and the precipitator to protect the electrical bushing from direct contact with the hot gases, but the baffling adds substantially to the cost and maintenance of a precipitator installation. Thus, it would be desirable to provide a new and improved bushing assembly which will withstand operation in an ambient of 150° C, enabling such apparatus as power supplies for hot precipitators to be mounted directly on the precipitator without requiring auxiliary baffling, and without premature bushing failure.

SUMMARY OF THE INVENTION

Briefly, the present invention is a new and improved electrical bushing assembly suitable for operation in an ambient of up to 150° C. The bushing assembly includes an elongated, hollow ceramic or porcelain insulating member in which the normally used silica ($SiO_2$) is eliminated and a substantial amount of $Al_2O_3$, such as calcined alumina, is added to the clay and feldspar. The elimination of the silica and the adding of the calcined alumina increases the structural strength of the insulating member, and its volume resistivity in ohm-cm is higher than that of conventional electrical porcelain at any selected ambient temperature throughout the operating temperature range.

An elongated electrical conductor is disposed coaxially within the opening of the insulating member. The electrical conductor is surrounded by solid insulation formed of a fibrous paper tape wound about the conductor to provide a plurality of layers of overlying wrappings. The paper tape is a fibrous web of wholly aromatic polyamide fibers.

The ends of the electrical conductor include sealing means mounted thereon for sealing the ends of the elongated insulating member. The sealing means includes gaskets which permit dimensional changes in the electrical conductor and associated insulating member, while maintaining a fluid-tight seal.

The clearance between the solid insulating means on the electrical conductor and the inner surface of the insulating member may be substantially reduced by utilizing a liquid dielectric within the sealed cavity defined by the insulating member and the sealing means, and in a preferred embodiment of the invention the cavity includes silicone oil, such as methylsilicone oil.

BRIEF DESCRIPTION OF THE DRAWING

The invention may be better understood, and further advantages and uses thereof more readily apparent, when considered in view of the following detailed description of exemplary embodiments, taken with the accompanying drawings in which.

DESCRIPTION OF THE PREFERRED EMBODIMENTS

Figure 2:
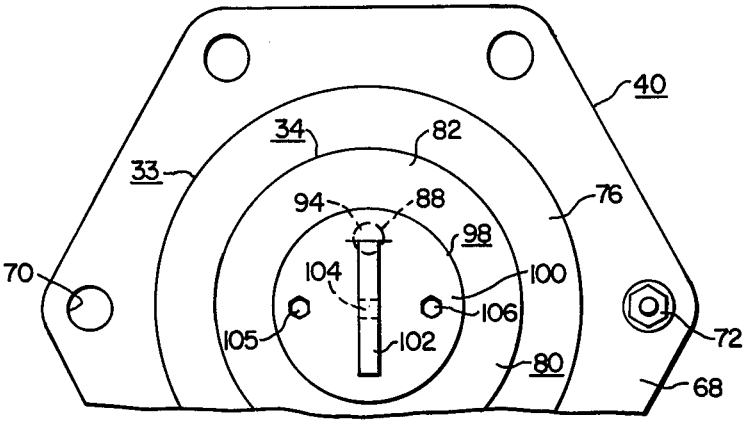
FIG. 2 is a plan view of the electrical insulating bushing shown in FIG. 1.
Figure 1:
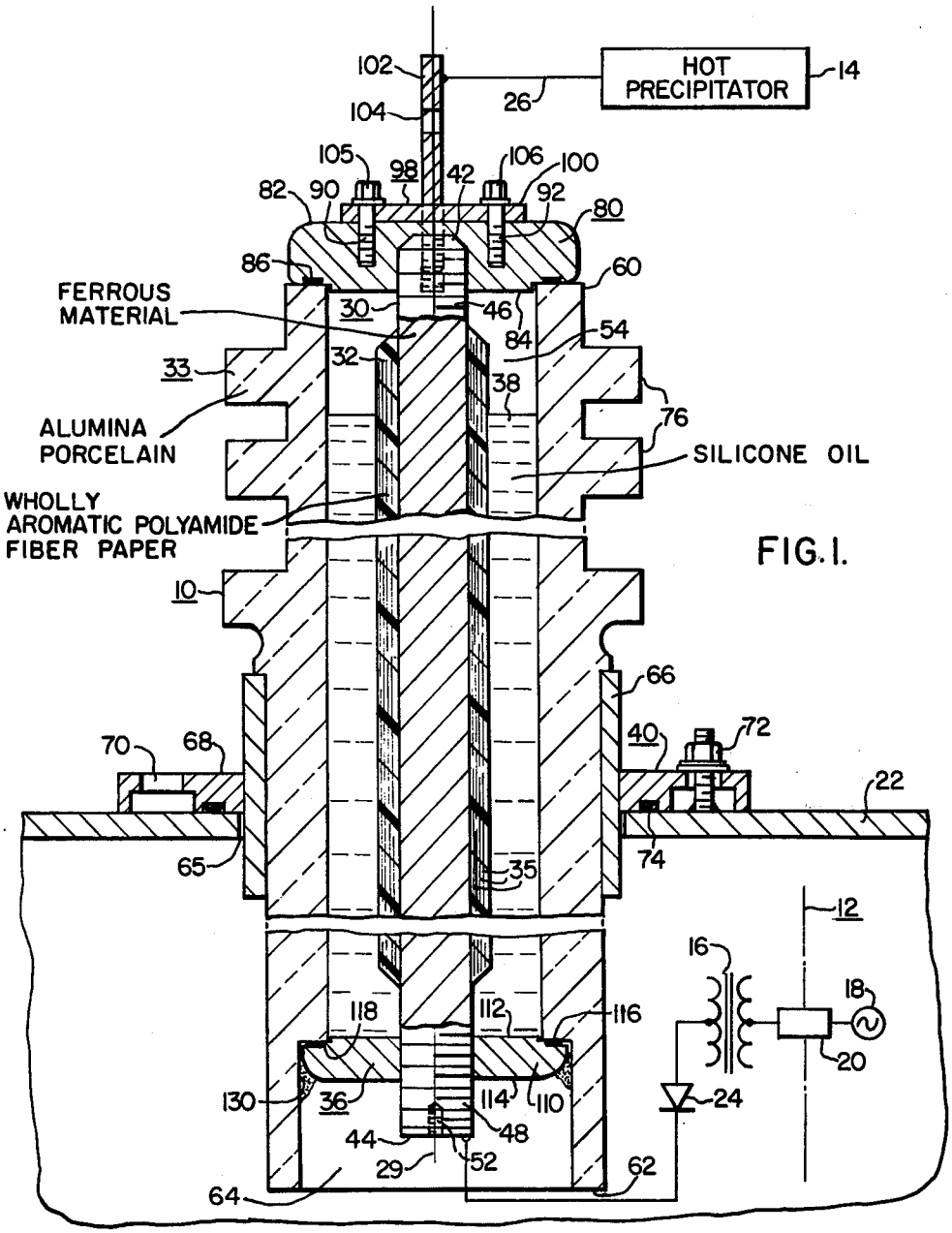
FIG. 1 is an elevational view, in section, of an electrical insulating bushing constructed according to the teachings of the invention.

Referring now to the drawings, FIG. 1 is an elevational view, in section, of a bushing assembly 10 constructed according to the teachings of the invention. The bushing assembly 10 is shown in FIG. 1 as part of a power supply 12 for a hot precipitator 14, but it may be used in any application where the ambient temperature may reach 150° C. FIG. 2 is a plan view of the bushing assembly 10 shown in FIG. 1, and it will also be referred to when describing the preferred embodiment of the invention.

More specifically, power supply 12 includes a step-up transformer 16, shown schematically, which may be a single or polyphase transformer, connected to a single or polyphase source 18 of alternating potential via suitable insulating bushings 20 disposed through the wall or cover of a tank or casing 22. The step-up transformer 16 provides a high voltage alternating potential which is rectified by a suitable single or polyphase rectifier, shown schematically at 24. The direct current voltage output from rectifier 24 is connected to the plates of the hot precipitator 14 via the high voltage insulating bushing assembly 10 and a conductor 26. A typical hot precipitator requires a direct current voltage of about 60 KV, and it is placed at a location where the hot gases to be cleaned may exceed a temperature of 150° C.

It is desirable to mount the power supply 12 directly on the hot precipitator 14, in order to reduce the length of the high voltage DC transmission line or conductor 26. Unfortunately, the temperature of the high voltage DC bushing of the power supply may reach 150° C, resulting in early failure of the bushing unless costly baffling is installed to prevent the hot gases from coming into contact with the bushing. The premature bushing failure may be due to one or more causes, such as:

a. thermal run away of the porcelain insulating shell. The volume resistivity (ohm-cm) of electrical porcelain drops with increasing temperature, and standard porcelain insulators will operate satisfactorily in an ambient temperature up to 100° C;

b. dielectric failure of the cellulosic insulating paper and mineral oil;

c. the thermal expansion of the bushing components destroys the fluid-tight seal, enabling the insulating fluid in the bushing cavity to escape.

Bushing assembly 10 shown in FIGS. 1 and 2 is constructed according to the teachings of the invention to provide a bushing which will operate at a high direct current voltage level and at an ambient temperature of 150° C.

Bushing assembly 10 has a generally elongated shape, with a longitudinal axis 29, and includes a centrally or axially disposed electrical conductor 30, solid electrical insulation 32 disposed about the conductor 30, an elongated ceramic insulating member 33, first and second sealing means 34 and 36, respectively, fluid electrical insulating dielectric means 38, and a mounting flange assembly 40.

Electrical conductor 30 may be a solid metallic rod having a circular cross sectional configuration, with the longitudinal axis of conductor 30 extending between first and second ends 42 and 44, respectively. Since the magnitude of the electrical current required for a hot precipitator is relatively low, such as 2 amperes for a 60 KV DC power supply, the electrical conductivity of the conductor 30 is not as important as its coefficient of thermal expansion. Since the ferrous materials have a lower coefficient of thermal expansion than copper or aluminum, the conductor is preferably constructed of steel, such as a stainless steel.

The outer surfaces of conductor 30 are threaded adjacent its first and second ends 42 and 44, as indicated at 46 and 48, respectively. The second end 44 of conductor 30 also has a tapped opening 52 therein, which opening is coaxial with the longitudinal axis of the conductor 30.

Solid insulation is disposed about conductor 30, which extends over substantially its complete length, between the threaded portions 46 and 48. Cellulosic paper impregnated with mineral oil provides an excellent insulating structure for the conductors of bushings which operate in an ambient temperature of 100° C, or less, but such an insulating structure is subject to early failure when operated at a temperature of 150° C. I have found that an excellent solid insulating structure may be provided for the solid insulation 32 of the bushing assembly 10, by utilizing paper, i.e., a felted sheet of fibers, with the paper being formed of wholly aromatic polyamide fibers. Paper made of wholly aromatic polyamide fibers, such as the paper sold commercially under the trademark Nomex, is made on a conventional paper making machine, and hence provides a water laid fibrous web available in densities suitable for the present application.

The solid insulation 32 is preferably formed of a sheet of wholly aromatic polyamide paper having a width dimension equal to the desired length of the solid insulation in the direction of the longitudinal axis 29. Three mil wholly aromatic polyamide paper wound on conductor 30 having a diameter of 1 inch (25.4 mm.) to provide a plurality of overlying wrappings 35 until the thickness dimension of the solid insulation is about 0.25 inch (6.35 mm.), has been found to provide a suitable insulating structure for a direct current voltage of 60 KV, but other suitable paper thicknesses and build dimensions may be used. Also, the wholly aromatic polyamide paper may be in the form of a paper tape, the width of which is less than the overall length of the solid insulating structure. The paper tape may be wound back and forth along the length of the conductor to provide the desired build of overlying wrappings. In general, the build dimension of the solid insulation 32 is selected to provide an outer diameter which provides an electrical gradient at the outer surface which is below the electrical breakdown strength of the adjoining insulating fluid.

The solid insulation 32 is preferably impregnated with a liquid dielectric, and in a preferred embodiment of the invention the liquid dielectric is a silicone oil, such as a methylsilicone oil having a viscosity of about 50 centistokes. Dow Corning's silicone oil No. 200 has been found to be suitable. If the insulating dielectric surrounding the solid insulation 32 is air, instead of silicone oil, the combination of conductor 30 and solid insulation 32 is constructed to provide the necessary diameter at the outer surface of the solid insulation which results in a potential gradient which is less than the electrical breakdown strength of air, and the clearance between the outer surface of the solid insulation and the inside diameter of the insulating member will be increased. Thus, the use of silicone oil 38 in the bushing cavity substantially reduces the overall diameter of the bushing assembly 10, and the silicone oil performs well at 150° C. As illustrated in FIG. 1, an air space 54 is provided above the level of the liquid dielectric 38 to enable the liquid dielectric to expand without building up high internal pressures within the bushing assembly.

The elongated ceramic insulating member 33 has first and second ends 60 and 62, respectively, and an opening 64 which extends between its ends. Conventional electrical porcelain is usually formed of clay, silica ($SiO_2$) and feldspar. The volume resistivity of porcelain drops with increasing temperature, and the conventional electrical porcelain has a limitation of about 100° C on the ambient temperature. The insulating member 33 is constructed to provide a ceramic which has an acceptable volume resistivity at an ambient temperature of 150° C. The volume resistivity versus temperature curve may be moved to the right by adding alumina ($Al_2O_3$), such as calcined alumina, to the ceramic mix, and in a preferred embodiment the amount of silica is substantially reduced or completely eliminated from the mix. A ceramic mix containing about 45% alumina has been found to be suitable, but other percentages may be used.

The mounting flange assembly 40 is disposed intermediate the ends 60 and 62 of the insulating member 33, which assembly enables the bushing 10 to be mounted through an opening 65 in the casing 22 of the power supply 12. The mounting flange assembly 40 includes a metallic, cylindrical or tubular member 66 formed of a material, such as stainless steel or aluminum, which is disposed coaxially about the outer surface of the insulating member 33. A flange member 68, which may also be formed of stainless steel or aluminum, extends perpendicularly outward from the tubular member 66, and is fixed thereto, such as with a stainless steel solder. The flange member 68 has a plurality of spaced openings 70 for receiving hardware 72 for mounting the flange 68 securely to the casing 22. The lower surface of the flange member 68 has a circumferential groove formed therein which receives a resilient gasket member 74, such as a gasket formed of a material sold under the trade name Viton, which is compressed against the tank 22 about the opening 65 to provide a fluid-tight seal. The tubular member 66, in addition to providing support for the flange member 68, provides a smooth metallic equipotential grounded surface between the conductor 30 and the sharp edges of the opening 65 defined by the casing 22.

The tank 22 is preferably filled with an insulating dielectric, such as transformer oil, and the portion of the insulating member 33 which extends into the oil filled tank may have a smooth outer surface. The portion of the insulating member 33 which is outside of the tank 22 preferably has a plurality of sheds 76 formed thereon, to increase the creep distance between the end 42 of conductor 30 and the grounded flange assembly 40 and tank 22.

The first and second sealing means 34 and 36 are constructed to provide fluid-tight seals between the conductor 30 and the insulating member 33. The first sealing means may include a metallic cap 80 having upper and lower surfaces 82 and 84, respectively, which in the preferred embodiment functions as a sealing member and also as part of an electrical terminal. The lower surface 84 has a threaded opening therein for receiving the thread 46 on end 42 of the electrical conductor 30, and the lower surface 84 may have a circular projection surrounding the tapped opening which is sized to snugly enter the opening 64 at the upper end of the insulating member 33. The lower surface of the cap 80 adjacent to the projection has an annular groove therein for receiving a resilient gasket member 86, which may be made of Viton. Gasket 86 is compressed between the first end 60 of the insulating member 33 and the cap 80, to seal the first end of the insulating member 33.

Cap 80 has a tapped opening 88, best shown in FIG. 2, which extends between its upper and lower surfaces 82 and 84, through which the liquid dielectric 38 may be added at an appropriate point during the manufacture and assembly of the bushing 10. A threaded insert member 94 is disposed in opening 88 after the bushing is assembled and the liquid dielectric 38 is added to the cavity.

Cap 80 also has a plurality of blind, tapped openings which extend inwardly from its upper surface 82, such as openings 90 and 92.

A terminal cap 98 includes horizontal member 100 having openings therein which may be aligned with the tapped openings 90 and 92 in the cap 80 for receiving bolts 105 and 106 which secure the terminal cap 98 to the cap 80. Terminal cap 98 also has an upwardly extending portion 102 which functions as a terminal for securing lead 26, and as such may have an opening 104 therein for receiving a suitable fastener.

The second sealing means 36 includes a cap member 110 and a resilient gasket member 116, such as a Viton gasket, for sealing the second end 62 of the insulating member 33. Cap 110 has a threaded opening which extends between upper and lower surfaces 112 and 114, respectively. Cap 110 is threadably engaged with the threads 48 on the second end 44 of conductor 30. The opening 64 at the second end 62 of insulating member 33 is stepped to provide a larger opening immediately adjacent end 62, and a shoulder 118 at the transition between the larger and smaller opening. Cap 110 has a circular outer configuration with a diameter selected to snugly enter the larger opening at end 62 of the insulating member 33. The upper surface 112 of cap 110 has a projection sized to snugly enter the smaller opening adjacent the shoulder 118, and the gasket 116 is disposed between the portion of cap 118 which is adjacent to the projection.

In the assembly of the bushing 10, the cap 110 is threadably advanced on end 44 of conductor 30 to a predetermined position, the gasket 116 is placed about the projection on the upper surface 112 of cap 110, and the conductor 30, with its insulation 32 disposed thereon, is advanced into the opening 64 in the insulating member 33 until the gasket 116 seats on the shoulder 118. The upper cap 80 with its gasket member 86 in place is threadably engaged with threads 46 adjacent to the first or upper end 42 of conductor 30, until both the upper and lower gasket members 86 and 116 are suitably compressed, which will firmly secure the insulated conductor 30 coaxially within the insulating member 33. The resulting assembled bushing, with insert 94 removed from cap 80 may then be baked to remove moisture from the assembly, and after baking the silicone oil 38 is added to the cavity in the insulating member 33 via the opening 88. After the oil has been added, insert 94, with a suitable adhesive such as an epoxy on its threads, is threadably engaged with the threads of opening 88. The top terminal cap assembly 98 is then secured to the cap 80.

The lower cap member 110 may be soldered to the conductor 33 with stainless steel solder. A suitable adhesive may be applied to the bushing assembly, such as an adhesive 130 between the outer periphery of lower cap 110 and the inner surface of insulating member 33, to insure that the oil cavity within the insulating member 33 is fluid-tight. The gaskets 86 and 116 function to allow dimensional changes of the bushing assembly to occur without destroying the fluid-tight seal.

I claim as my invention:

1. A high temperature bushing assembly for interconnecting a high voltage direct current power supply and a hot precipitator in an ambient temperature up to 150° C, comprising:

an elongated ceramic insulating member having first and second ends, and an opening which extends between its ends, said insulating member including $Al_2O_3$ in its formulation, to increase the electrical volume resistivity of said insulating member, a single elongated metallic electrical conductor having first and second ends disposed coaxially within said insulating member, said electrical conductor being constructed of a ferrous material to provide a relatively low coefficient of thermal expansion, first and second sealing means each including a gasket member associated with the first and second ends, respectively, of said electrical conductor, which cooperate with the first and second ends, respectively, of said insulating member to provide a fluid-tight cavity within said insulating member while allowing thermally induced dimensional changes in said ferrous electrical conductor and insulating member, solid insulating means disposed about said electrical conductor intermediate its ends, said solid insulating means including a plurality of layers of fibrous overlying wrappings formed of wholly aromatic polyamide fibers, silicone oil disposed in the fluid-tight cavity, said silicone oil impregnating the fibrous wrappings of said solid insulating means, and mounting means on the insulating member including a tubular metallic member coaxial with the longitudinal axis of the insulating member, and a flange member which extends perpendicularly outward from the tubular metallic member.

* * * * *